United States Patent [19]

Bechtold et al.

[11] Patent Number: 5,065,018

[45] Date of Patent: Nov. 12, 1991

[54] TIME-OF-FLIGHT SPECTROMETER WITH GRIDLESS ION SOURCE

[75] Inventors: Paul S. Bechtold, Cologne; Matija Mihelcic, Juelich; Kurt Wingerath, Moenchen-Gladbach, all of Fed. Rep. of Germany

[73] Assignee: Forschungszentrum Juelich GmbH, Juelich, Fed. Rep. of Germany

[21] Appl. No.: 450,324

[22] Filed: Dec. 14, 1989

[30] Foreign Application Priority Data

Dec. 14, 1988 [DE] Fed. Rep. of Germany ..... 3842044

[51] Int. Cl.[5] ..... H01J 49/40

[52] U.S. Cl. ..... 250/287; 250/281; 250/423 R; 250/423 P

[58] Field of Search ..... 250/281, 282, 288, 287, 250/423 P

[56] References Cited

U.S. PATENT DOCUMENTS

| | | | |
|---|---|---|---|
| 3,944,873 | 3/1976 | Franks | 250/423 R |
| 3,992,632 | 11/1976 | Kruger et al. | 250/423 R |
| 4,072,862 | 2/1978 | Mamyrin | 250/287 |
| 4,295,046 | 10/1981 | Grüter et al. | 250/287 |
| 4,365,157 | 12/1982 | Unsöld | 250/287 |
| 4,556,794 | 12/1985 | Ward et al. | 250/309 |
| 4,625,112 | 11/1986 | Yoshida | 250/287 |
| 4,694,168 | 9/1987 | Le Beyec et al. | 250/287 |
| 4,731,532 | 3/1988 | Frey et al. | 250/287 |
| 4,889,987 | 12/1989 | Gruen et al. | 250/282 |
| 4,933,551 | 6/1990 | Bernius et al. | 250/423 R |

FOREIGN PATENT DOCUMENTS 60-121662 6/1985 Japan .

OTHER PUBLICATIONS

Wiley et al., "Time-of-Flight Mass Spectrometer with Improved Resolution," The Review of Scientific Instruments, vol. 26, No. 12, Dec. 1955, pp. 1150–1157.

Frey et al., "A High-Resolution Time-of-Flight Mass Spectrometer Using Laser Resonance Ionization," Journal For Natural Research, 1985, Issue 12, p. 1349.

"Mass Spectrometry," Van Nostrand's Scientific Encyclopedia, pp. 1836–1838, 1982.

*Primary Examiner*—Bruce C. Anderson

*Attorney, Agent, or Firm*—Foley & Lardner

[57] ABSTRACT

A time-of-flight spectrometer includes a gridless ion source for generating ions. The ions are reflected by a reflector and detected in a detector. Different types of ions, indicative of the chemical make-up of a sample, have different times of flight. The ion source includes apertured gridless electrodes to establish a specific potential distribution. The potential distribution can be established utilizing electrodes having apertures of varying diameters. The spectrometer also includes mechanical structure for varying the angle of the detector.

21 Claims, 8 Drawing Sheets

TIME-OF-FLIGHT SPECTROMETER WITH GRIDLESS ION SOURCE

BACKGROUND OF THE INVENTION

The invention is in the field of time-of-flight (TOF) spectrometry. Specifically, the invention relates to TOF spectrometers which include an ion generating source which generates a pulsed ion beam.

Mass spectrometers permit rapid analysis of chemical compounds. A mass spectrometer generally includes a vacuum tube into which a small amount of a gas to be examined is admitted. The gas is ionized, for example by use of a pulsed laser, and the ions are accelerated. The time that it takes an ion to reach a detector is a function of the ratio of the charge q of an ion to the mass m of the ion. Therefore, when ions reach the detector, the ions have separated into bunches corresponding to q/m values. The values of q/m exhibited for a given sample indicate the chemical make-up of the sample.

A reflector can be provided in the flight path of the ions to compensate for the flight times of ions with different energies. Higher energy electrons penetrate deeper into a reflecting field of the reflector and accordingly spend a longer time in the reflector to compensate for the shorter flight times of the higher energy ions in non-field regions. This compensation is called velocity focusing.

General background information on TOF mass spectrometry is provided in "Time-of-Flight Mass Spectrometer with Improved Resolution" by W. C. Wiley et al., appearing in *The Review of Scientific Instruments.* December 1955, Vol. 26, No. 12, incorporated herein by reference.

TOF mass spectrometry has a major advantage in permitting the simultaneous examination of ions spanning a large mass range. Recently, TOF spectrometry has been used in the mass analysis of cluster beams and the analysis of fragments of large organic molecules, since these applications require examination of ions spanning a large mass range. Analysis of particles expelled in combustion processes is also possible In these fields of application, the low density of the particles to be analyzed make analysis difficult. In addition, in these applications, adequate resolution is difficult to achieve.

Commercially available mass spectrometers usually include potential-shaping wire meshes in both the ion source and the reflector. Wire mesh electrodes are also frequently employed in the detector as well. These meshes reduce the transmission of the ions and cause undesirable secondary effects, such as fragmentation, sputtering of secondary particles, and electron emission by ion impact.

"A High-Resolution Time-of-Flight Mass Spectrometer Using Laser Resonance Ionization" by R. Frey et al., appearing in the *Journal For Natural Research.* 1985, Issue 12, page 1349 discloses a nonmesh reflector. In the Frey spectrometer, however, the ions must be produced in a very small ionization volume, e.g., 0.1 mm in diameter focus volume, due to the lack of space focusing. This small ionization volume results in poor overall detection sensitivity since sensitivity is proportional to the original ionization volume. The Frey article does not disclose or suggest a non-mesh source. Furthermore, the Frey article does not disclose specific types of potential distributions to be used with the Frey reflector.

The term "space focusing" refers to compensating for differences in times of flight resulting from a finite ionization volume. Space focusing compensates for the finite size of the original ion bunch by concentrating particles within one bunch in the axial direction. Space focusing is different from radial focusing, which results in a smaller beam diameter In conventional instruments, space focusing is achieved with the aid of grids, as discussed in the W. C. Wiley et al. article cited above. These grids reduce the transmission of ions since a portion of the ions collide with the grids.

SUMMARY OF THE INVENTION

An object of the invention, therefore, is to provide a TOF spectrometer with improved transmission, high mass resolution, minimal secondary effects, and high detection sensitivity.

Another object of the invention is to provide a TOF spectrometer with a large ionization volume and greater overall sensitivity.

According to a first aspect of the invention, there is provided a TOF spectrometer which includes a gridless ion source. The gridless ion source includes potential shaping electrodes and generates an ion beam. A detector generates signals indicative of the ion beam. Each of the electrodes includes exactly one aperture through which the ion beam passes. A reflector can also be provided to velocity focus the ion beam by reversing the ion beam. The electrodes create a beam-concentrating and space focusing potential distribution. A preferred potential distribution has at least two local extremes along an axis of the ion source. The spectrometer can include a channel plate detector which includes structure for adjusting the location of the detector area and an angle of incidence relative to the ion beam.

According to another aspect of the invention, there is provided a method of spectrometry which includes creating a first potential distribution in a gridless ion source. Ions are then accelerated utilizing the first potential distribution. The times of flight of the ions are detected and signals are generated indicative of the times of flight. The potential distribution can be derived utilizing a relaxation method and optimizing electrostatic potentials utilizing solutions of a Laplace equation.

BRIEF DESCRIPTION OF THE DRAWINGS

The invention will be described in further detail below with reference to the accompanying drawing wherein:

FIG. 7(*b*) illustrates a detector according to the instant invention; and

DETAILED DESCRIPTION OF THE PREFERRED EMBODIMENTS

Figure 1:
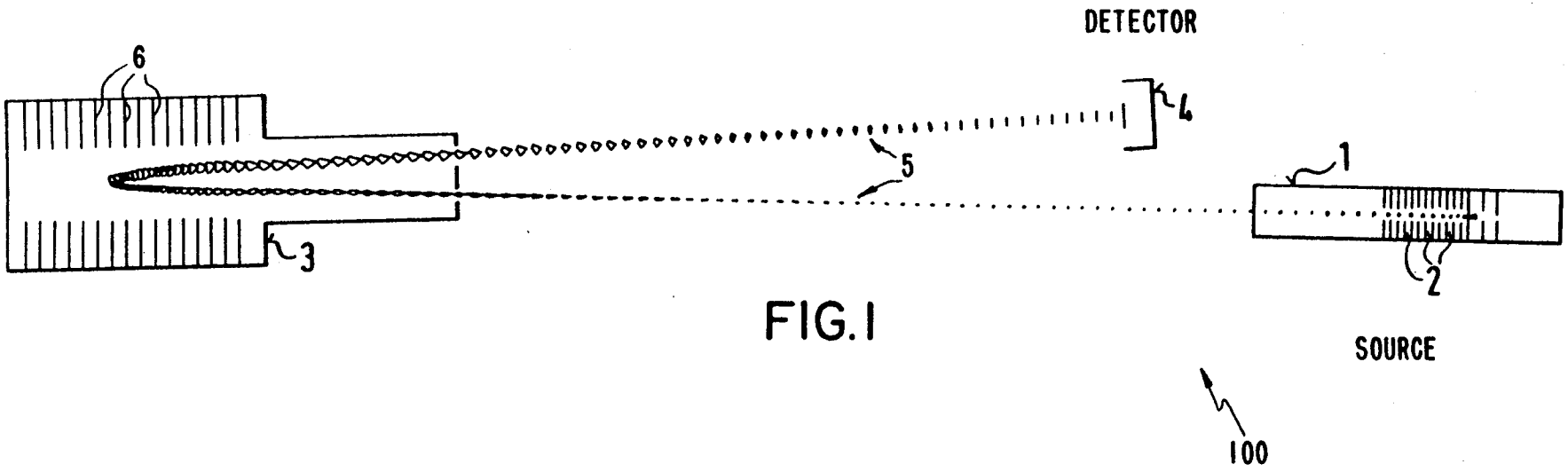
FIG. 1 illustrates an optimized beam profile TOF mass spectrometer according to a preferred embodiment of the invention.

FIG. 1 illustrates a TOF mass spectrometer 100 according to a preferred embodiment of the invention. The preferred embodiment 100 includes an ion source 1, reflector 3 and a detector 4. FIG. 1 also illustrates the shape of an ion package of a mass, e.g., a mass of 560 amu, in time increments of 500 ns. This path is designated by reference number 5.

In FIG. 1, ions of a sample are generated by the source 1 and are accelerated in the direction of reflector 3. In the preferred embodiment, ions are formed in the ion source 1 by laser pulsed ion generation. The reflector 3 reflects the ions back to the detector 4. The reflector 3 acts to compensate for the various velocities of the ions, as described above. The detector 4 generates signals over time indicative of the number of ions striking the detector 4. Since ions with different charge-to-mass ratios q/m will strike the detector 4 at different times, the signal from the detector 4 indicates q/m ratios, and thus, the chemical makeup, of the sample. The FIG. 1 preferred embodiment can also be used for TOF spectrometry independent of mass detection.

In the source 1, a pulsed ion beam, originating from a shot-in beam of neutral particles, surface sputtering, or other methods, generated in the source 1, is concentrated spatially and temporally by an arrangement of electrodes 2 each having exactly one aperture. The reflector 3 also includes an arrangement of gridless apertured electrodes 6 to compensate for differences in ion velocity by directional reversal so that ions with the same q/m arrive simultaneously at detector 4. For certain applications, the reflector 3 can be omitted.

In prior art TOF spectrometers, both the ion source and the reflector usually contain potential-shaping wire meshes. Prior art detectors also frequently include a mesh on the detector. The instant invention does not utilize wire meshes. The elimination of wire meshes improves transmission and suppresses undesirable secondary effects.

Figure 2:
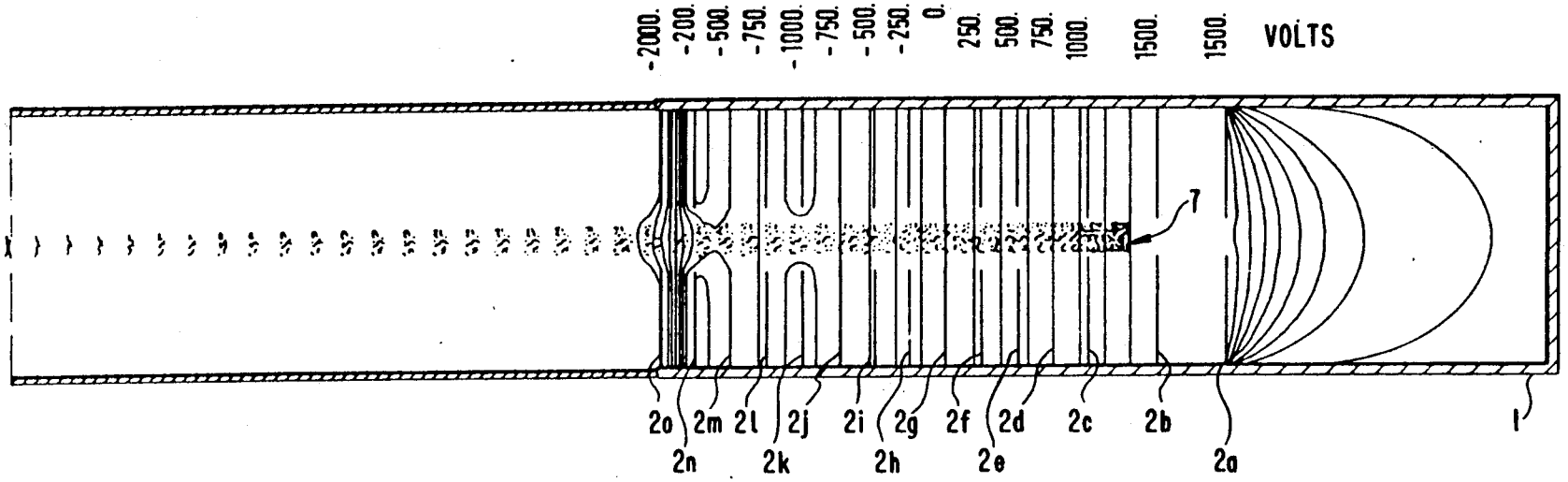
FIG. 2 illustrates an optimized potential distribution in an ion source of FIG. 1.
Figure 3:
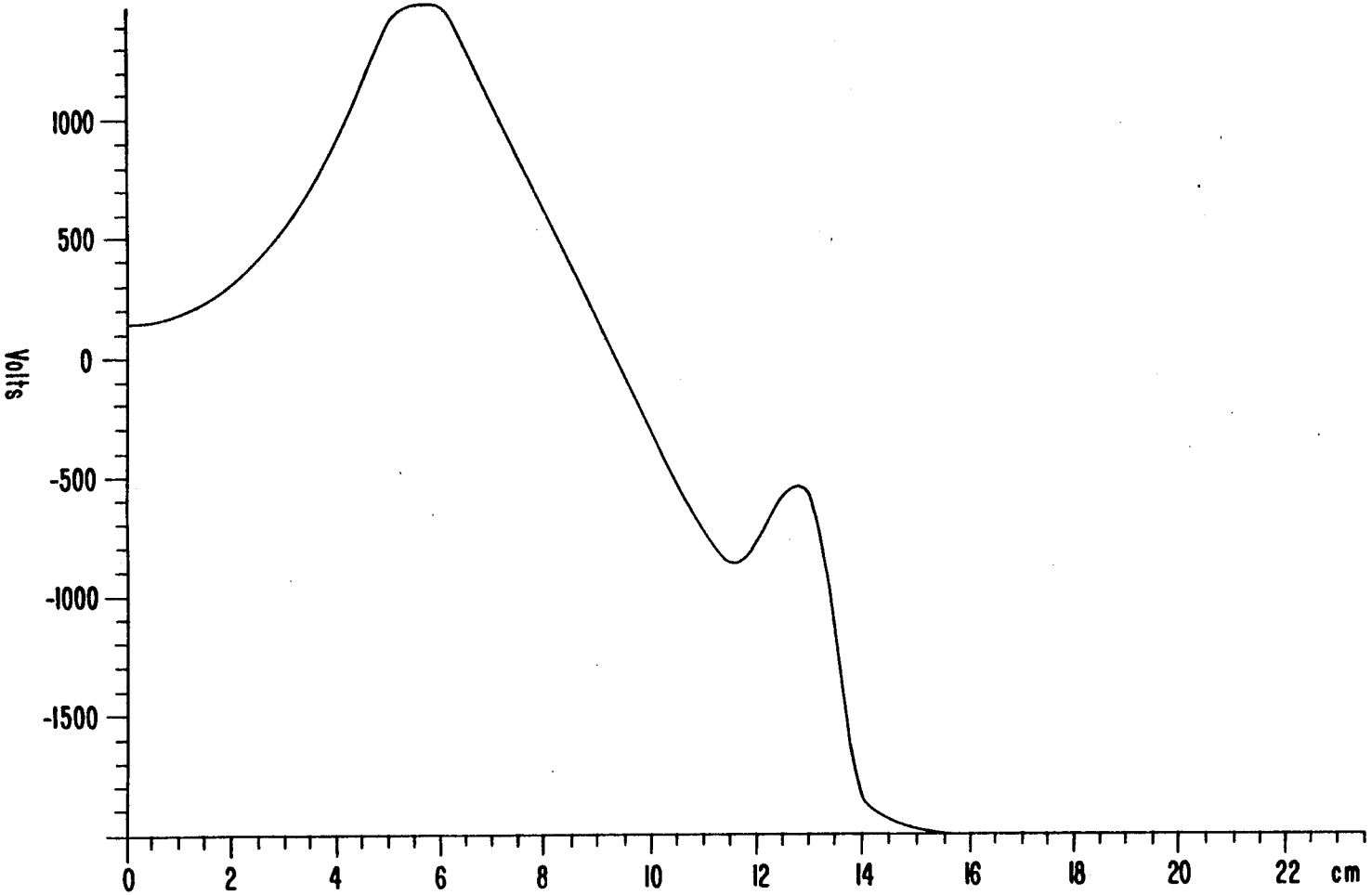
FIG. 3 illustrates an axial potential distribution of the ion source of FIG. 2.

In the invention, beam guidance and beam shaping in source 1 and reflector 3 is accomplished by two methods. In the first method, electrodes 2 and 6 are utilized for beam guidance and beam shaping through use of a programmed potential distribution. This method is shown in FIG. 2. In FIG. 2, the potentials of electrodes 2*a* to 2*o* are established as indicated at the top of FIG. 2. FIG. 3 illustrates a typical potential distribution for source 1.

Figure 4:
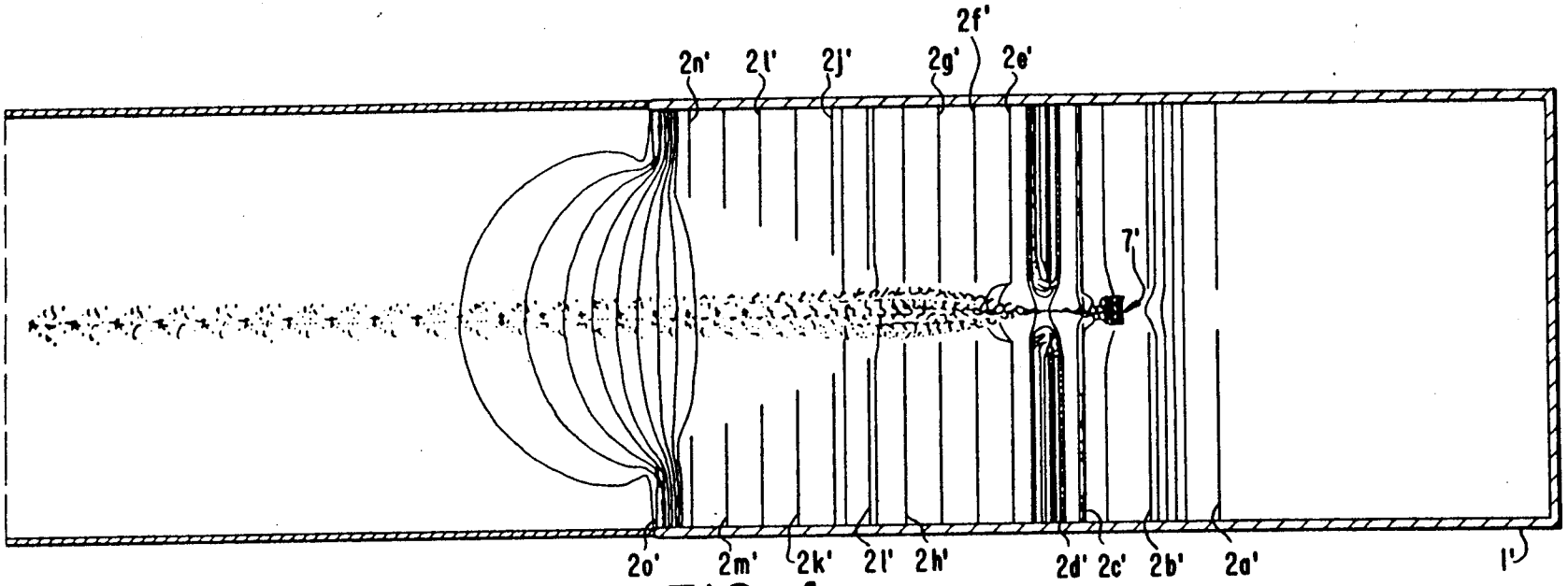
FIG. 4 illustrates an ion source having a modified geometry.

In the second method, the shape of the electrodes is additionally varied to produce optimum beam shaping, as illustrated in FIG. 4. In FIG. 4, the aperture sizes in electrodes 2*a*′ through 2*o*′ are varied to accomplish the desired beam shaping.

In the preferred embodiments, the ion sources 1 and 1′ each have 15 parallel apertured electrodes. The apertures are coaxial and permit the free passage of the ions. In FIG. 2 all of the electrodes have the same shape for the sake of simplicity of construction. In FIG. 4, the electrodes have varying aperture diameters.

In both FIGS. 2 and 4, at least two electrodes 2*a* or 2*a*′ and 2*b* or 2*b*′ are provided upstream of ionization locations 7 or 7′. In FIG. 2, these two electrodes are at the same potential and serve as repeller electrodes for the homogenization of the potential at the ionization locations.

More or less than fifteen electrodes can be provided. Preferably, a minimum of three electrodes should be provided. An arrangement of 8 to 20 electrodes has been found to be the most practical arrangement. In the illustrated embodiments, the electrodes downstream of the ionization location are spaced an equal distance apart, however the distance between electrodes can be varied. If the distance between electrodes is varied, the voltages applied to the electrodes must be varied accordingly, in order to produce the desired potential distribution.

The detector 4 can be slightly negatively biased, particularly with respect to the flight tube, in order to suppress secondary electrons. In the preferred embodiment, the detector 4 is a channel-plate detector and includes mechanical structure for adjusting the position of the detector, the detector area of incidence, and the angle of the detector relative to the incident beam.

The potential distribution generated by either of the two methods described above serves to concentrate and space focus the ion beam. Virtually all of the ions generated are guided in the beam direction.

In the invention, each aperture acts as an ion-optical lens. The number of electrodes and the voltages applied to the electrodes are adjusted such that the potential distribution shapes and space focuses the ion beam, without a grid. This technique minimizes chromatic aberration of the ion source. The absence of grids in the whole spectrometer allows transmission of virtually 100% of the ions, particularly with an ionization volume of a few 100 $mm^3$.

The necessary potential distribution can be calculated in various ways. For example, the charge density calculation method, which utilizes the density of induction charges on the electrode surfaces, or standard matrix methods can be employed. The preferred method is a relaxation method which optimizes the electrostatic potentials by solution of the Laplace equation. In this method, the number of electrodes, the diameter of the electrode apertures, electrode spacing, and electrode voltages are used as variables.

The structure and design of the ion source 1 results in a significant increase in instrument sensitivity in addition to concentrating the ion beam. This increase in sensitivity results from the space focusing achieved by the ion source. The ion source is capable of concentrating a very large ionization volume, e.g., 0.1 to 1.0 $cm^3$. Since the invention permits the use of a larger ionization volume, and thus more sample material, the spectrometer 100 produces evaluable signals at the detector 4 even when the sample material has a low particle density.

A potential distribution with at least two local extreme values moving along the axial direction, such as the −1000 and −200 values in FIG. 2, results in a minimization of chromatic aberration as well as space focusing. In other words, the first derivative of the potential distribution passes through at least two zero values.

Figure 5:
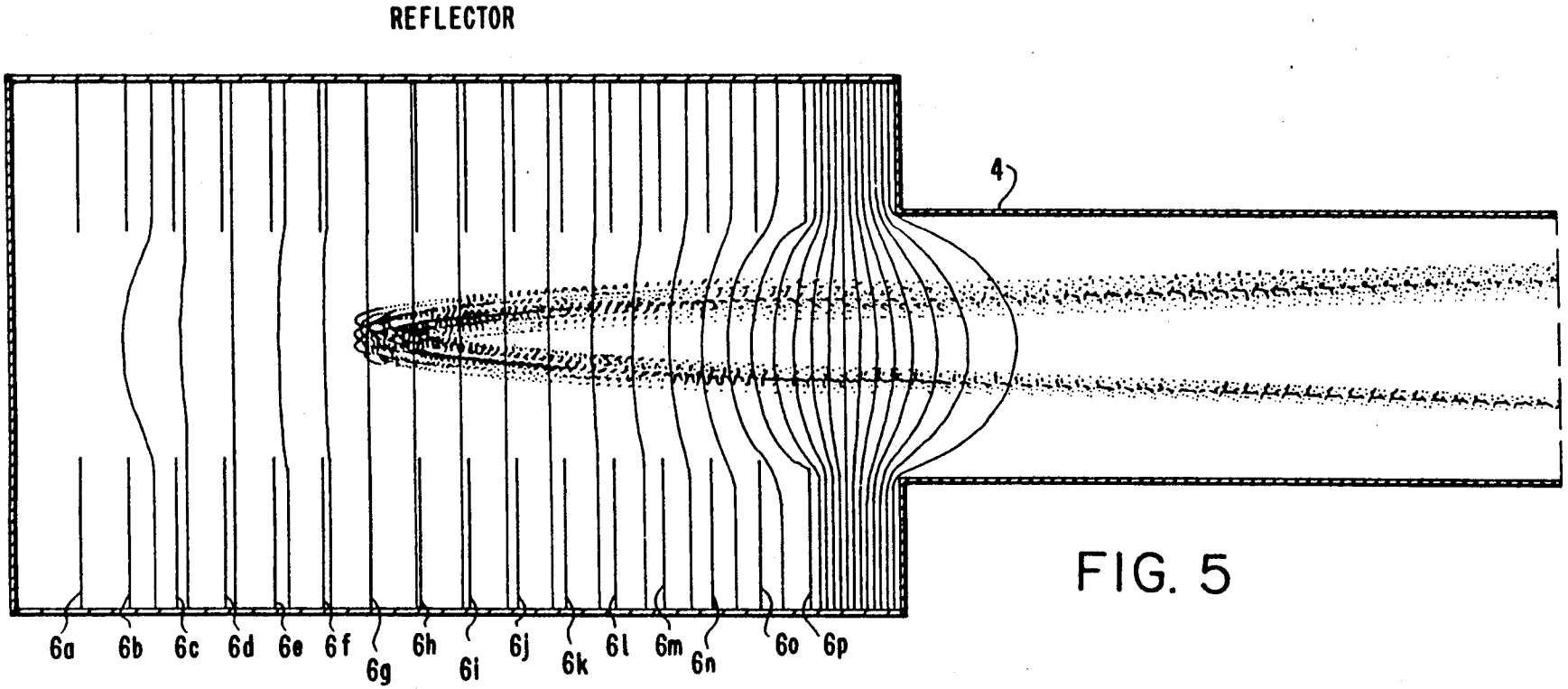
FIG. 5 illustrates a potential distribution and beam profile of an electrostatic reflector of FIG. 1.
Figure 6:
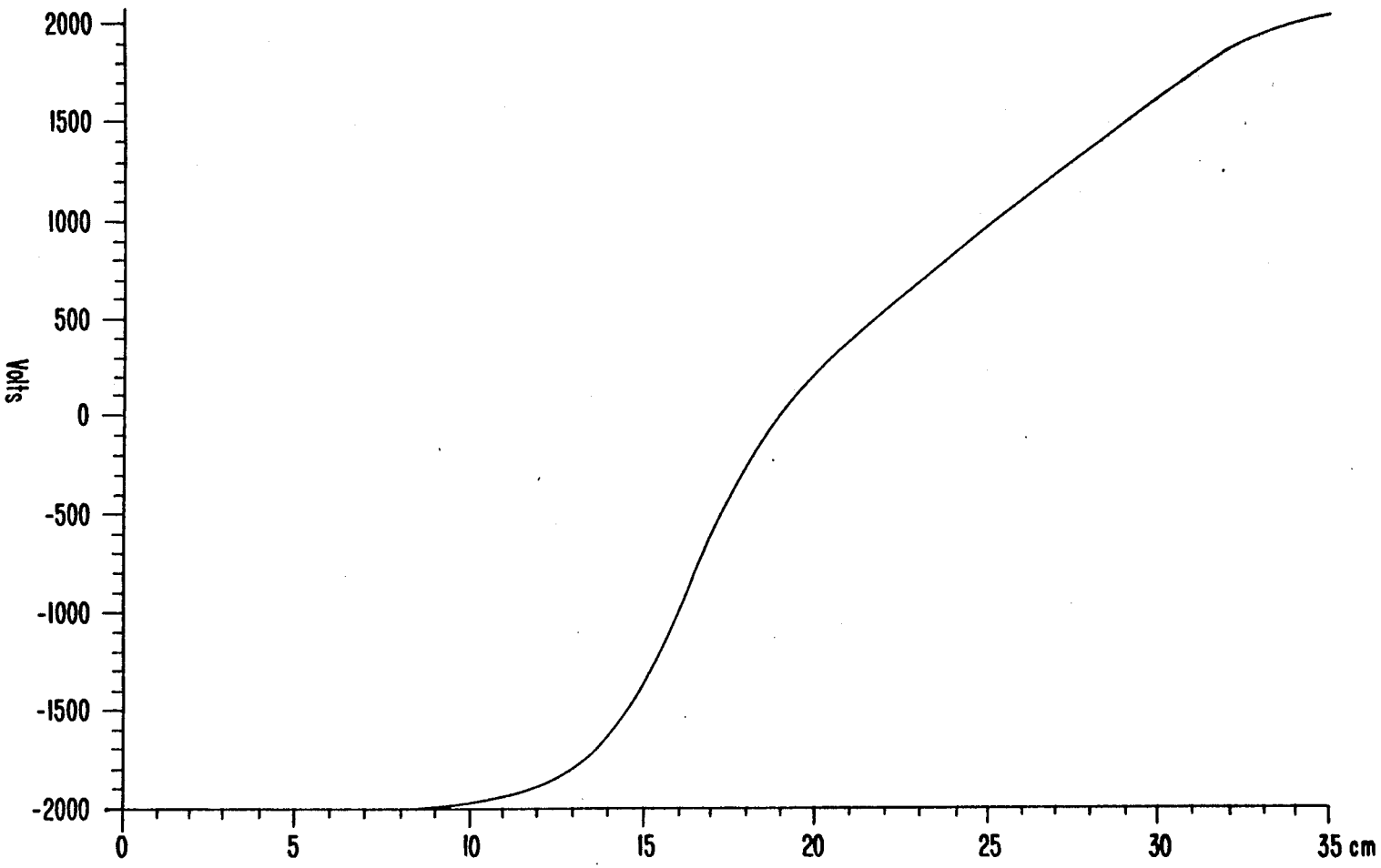
FIG. 6 illustrates an axial potential distribution of the reflector of FIG. 5.

The reflector 4 is designed similarly to the ion source 1, as illustrated in FIG. 5. FIG. 6 illustrates a typical potential distribution for reflector 4. The number of electrodes 6 and the electrode voltages of the reflector are determined in a manner similar to that described above with respect to ion source 1.

Figure 7A:
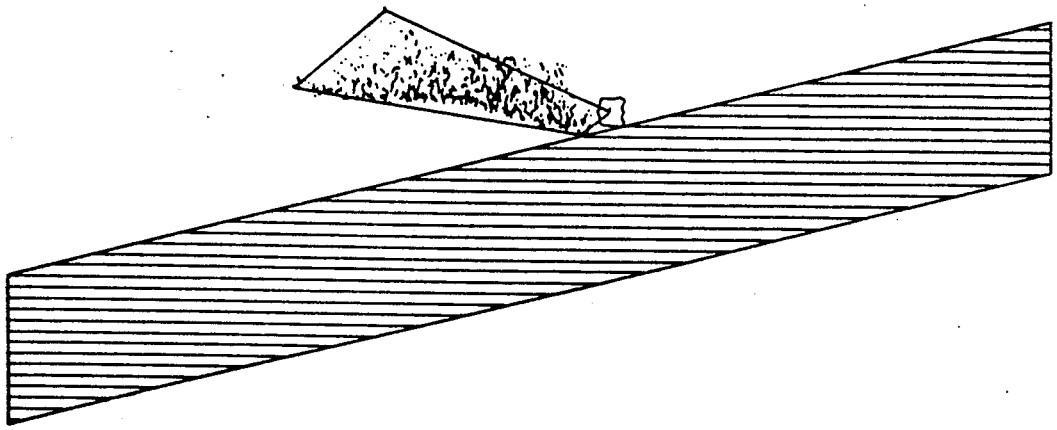
PRIOR ART FIG. 7A
FIG. 7(*a*) illustrates a conventional detector.
Figure 7B:
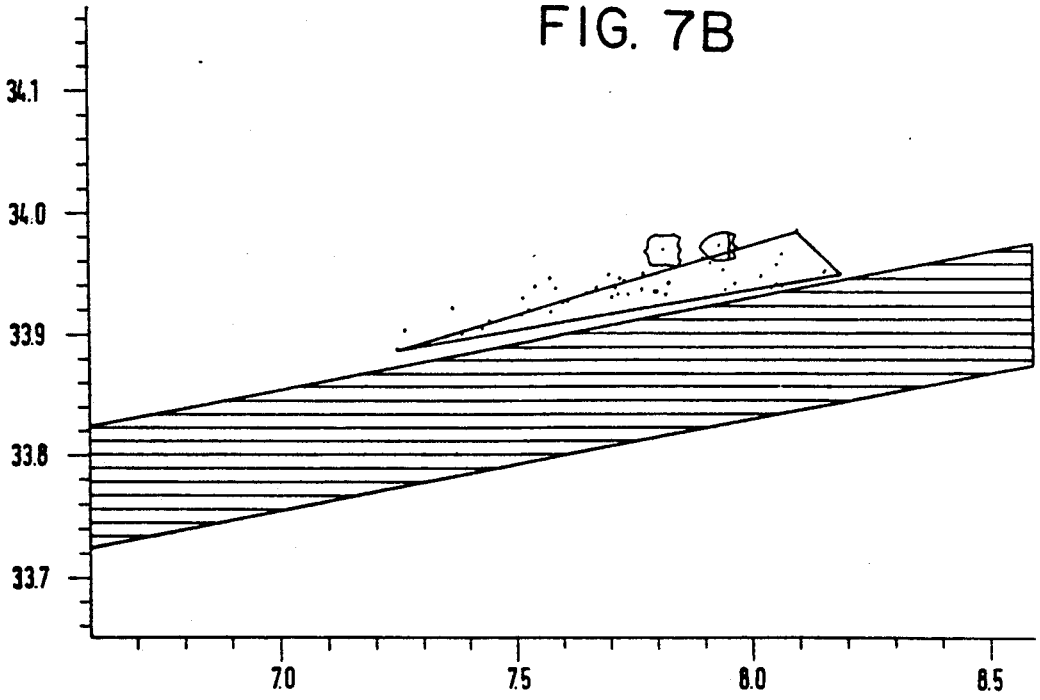

FIGS. 7(*a*) and 7(*b*) diagrammatically illustrate the effect of rotating and moving the channel plate detector to optimize resolution and sensitivity. In FIGS. 7(*a*) and 7(*b*), the position of the channel plates is indicated diagrammatically by the shaded areas. In both figures, the polygon illustrated connects the two outermost particles of an ion bunch, the one that arrives first, and the one that arrives last. FIGS. 7(*a*) and 7(*b*) illustrate the effect of inclining the detector surface with respect to the beam axis. In FIG. 7(*a*), the surface of the detector, indicated by the shaded area, is perpendicular to the beam axis. In FIG. 7(*b*), the detector surface is inclined with respect to the beam axis to improve time resolution.

Figure 8:
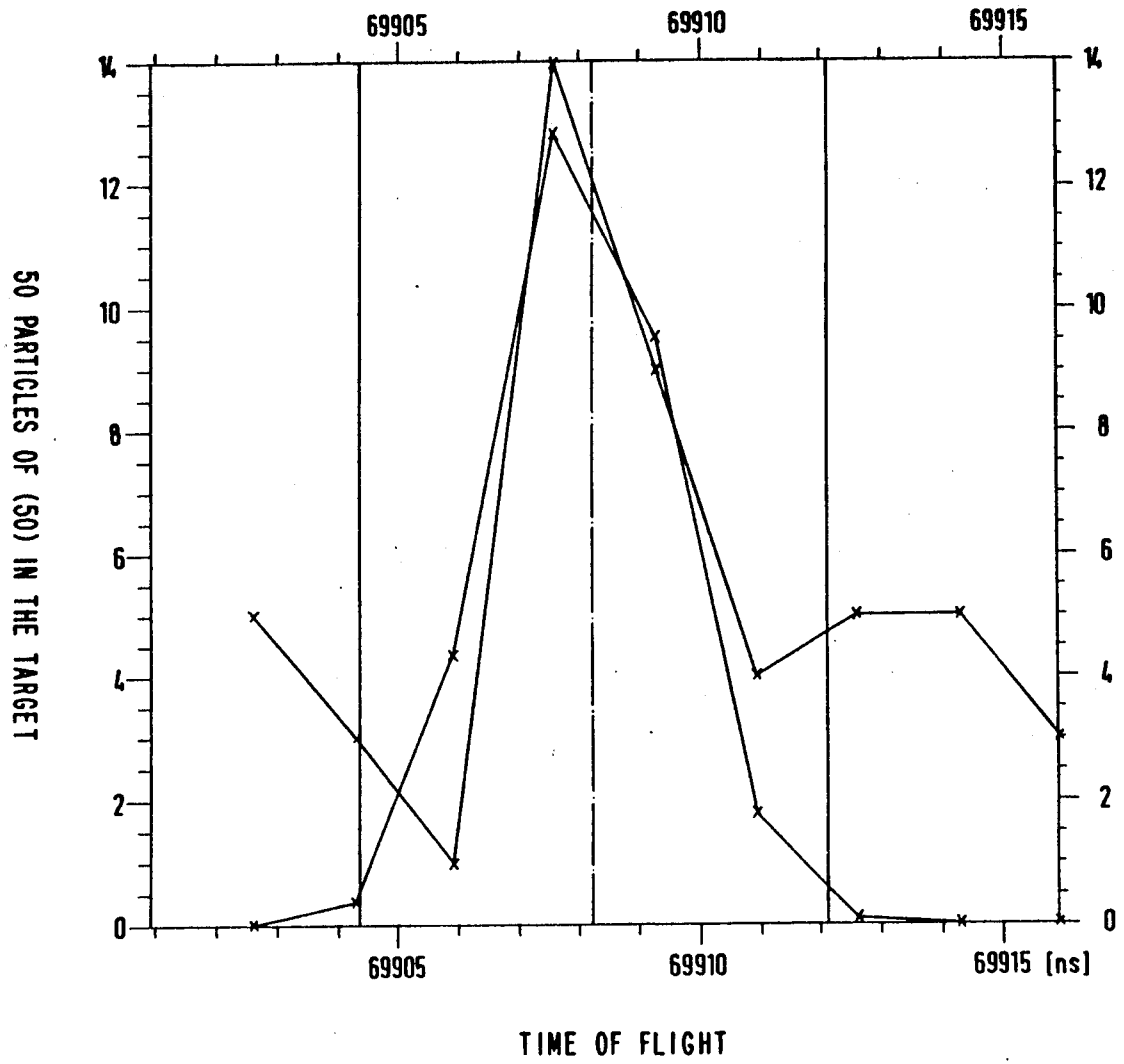
FIG. 8 illustrates the signal distribution of an investigation of $Fe_{10}$ iron clusters utilizing the invention.

FIG. 8 illustrates the results of an ion cluster investigation of iron cluster ions. As illustrated by FIG. 8, the invention achieves outstanding mass resolution. The invention achieves a mass resolution $m/\Delta m$ of several thousand with virtually 100% transmission.

Fully or partially conical, spherical shell-like, or similarly shaped coaxial electrodes can be provided in lieu of flat electrodes.

The foregoing description has been set forth merely to illustrate preferred embodiments of the invention and is not intended to be limiting. Since modification of the described embodiments incorporating the spirit and substance of the invention may occur to persons skilled in the art, the scope of the invention should be limited solely with respect to the appended claims and equivalents.

What is claimed is:

1. A time-of-flight spectrometer, comprising:

a gridless ion source having a series of more than two potential-shaping coaxial apertured electrodes creating a beam-concentrating and space-focusing potential distribution, said potential distribution having at least two local extremes along an axial axis of said source, said source generating an ion beam; and a detector, said detector generating signals indicative of said ion beam.

2. A time-of-flight spectrometer as set forth in claim 1, wherein each of said electrodes has only one aperture through which said ion beam passes and wherein said electrodes are substantially parallel to one another.

3. A time-of-flight spectrometer as set forth in claim 1, further comprising:

a reflector to velocity focus said ion beam by reversing said ion beam.

4. A time-of-flight spectrometer as set forth in claim 1, wherein said ion beam is a pulsed ion beam.

5. A time-of-flight spectrometer as set forth in claim 1, wherein said ion beam is generated utilizing a laser-pulsed ion beam.

6. A time-of-flight spectrometer as set forth in claim 5, further comprising a gridless reflector.

7. A time-of-flight spectrometer as set forth in claim 1, further comprising a gridless reflector.

8. A time-of-flight spectrometer as set forth in claim 1, wherein said detector includes a channel plate detector and wherein said spectrometer further comprises an adjusting means for adjusting a location of a detector area of incidence and an angle of incidence relative to said ion beam.

9. A time-of-flight spectrometer as set forth in claim 1, wherein a number of said electrodes is between 7 and 21 and wherein said electrodes have substantially identical diameter apertures and wherein electrodes downstream of an ion generation location are spaced substantially the same distance apart.

10. A time-of-flight spectrometer as set forth in claim 1, wherein at least two of said electrodes have apertures of different aperture diameters.

11. A time-of-flight spectrometer as set forth in claim 1, wherein at least two of said electrodes are located upstream of an ionization location and are at substantially the same potential such that potentials at said ionization location are substantially uniform.

12. A time-of-flight spectrometer as set forth in claim 1, wherein said ion beam is generated utilizing a laser-pulsed ion beam.

13. A time-of-flight spectrometer as set forth in claim 1, further comprising a gridless reflector.

14. A method of spectrometry, comprising the steps of:

(a) creating a beam-concentrating and space-focusing first potential distribution in a gridless ion source utilizing a series of more than two potential-shaping coaxial apertured electrodes;

(b) accelerating ions utilizing said first potential distribution; and (c) detecting times of flight of said ions and generating signals indicative of said times of flight.

15. A method of spectrometry as set forth in claim 14, wherein step (a) includes:

establishing said first potential distribution utilizing a relaxation method; and optimizing electrostatic potentials utilizing solutions of a Laplace equation.

16. A method of spectrometry as set forth in claim 14, further comprising the step of generating said ions utilizing a laser-pulsed ion beam.

17. A method of spectrometry as set forth in claim 14, further comprising reflecting said ions utilizing a gridless reflector.

18. A method of spectrometry as set forth in claim 14, wherein said first potential distribution has at least two local extremes along an axial axis.

19. A method of spectrometry as set forth in claim 14, further comprising:

adjusting a location of a detector area of incidence and an angle of incidence relative to a path of said ions.

20. A time-of-flight spectrometer, comprising:

a gridless ion source having a series of more than two potential-shaping coaxial apertured electrodes creating a beam-concentrating and space-focusing potential distribution, said potential distribution having at least two local extremes along an axial axis of said source, said source generating a pulsed into beam; and a detector, said detector generating signals indicative of said ion beam.

21. A method of spectrometry, comprising the steps of:

(a) creating a beam-concentrating and space-focusing first potential distribution in a gridless ion source utilizing a series of potential-shaping coaxial apertured electrodes;

(b) accelerating ions utilizing said first potential distribution; and (c) detecting times of flight of said ions and generating signals indicative of said times of flight.

* * * * *